US005906155A

United States Patent [19]

Hammond

[11] Patent Number: 5,906,155

[45] Date of Patent: May 25, 1999

[54] PRESS FRAME

[76] Inventor: Kerry Hammond, Box 98, Tofield, Alberta, Canada, T0B 4J0

[21] Appl. No.: 08/982,345

[22] Filed: Dec. 2, 1997

[51] Int. Cl.[6] ..... B30B 1/32

[52] U.S. Cl. ..... 100/231; 29/251; 29/252; 100/269.18

[58] Field of Search ..... 100/231, 269.01, 100/269.06, 269.17, 269.18, 269.19; 29/251, 252; 72/453.01, 453.02, 455; 83/639.1, 639.5, 859; 92/169.1

[56] References Cited

U.S. PATENT DOCUMENTS

| | | | |
|---|---|---|---|
| 1,324,099 | 12/1919 | Barr | 29/252 |
| 1,351,424 | 8/1920 | Jenkins | 29/252 |
| 1,951,573 | 3/1934 | Gehrig | 29/252 |
| 2,049,484 | 8/1936 | Workall | 29/252 |
| 2,269,914 | 1/1942 | Parker | 83/639.1 |
| 2,512,246 | 6/1950 | Fishburne | 100/231 |
| 3,068,483 | 12/1962 | Moehlenpah et al. | 100/269.06 |
| 3,103,876 | 9/1963 | Ferranti | 100/269.06 |
| 3,207,406 | 9/1965 | Bowman | 100/269.06 |
| 3,247,783 | 4/1966 | Hammon | 100/269.06 |
| 3,299,761 | 1/1967 | Goldman | 83/639.5 |
| 3,463,042 | 8/1969 | Goldman | 83/639.1 |
| 3,595,163 | 7/1971 | Bauman . | |
| 3,686,922 | 8/1972 | Bley . | |
| 4,096,727 | 6/1978 | Gargaillo | 83/639.1 |
| 4,173,181 | 11/1979 | Beneteau . | |
| 4,686,897 | 8/1987 | Frank . | |
| 4,726,273 | 2/1988 | Miceli | 83/639.1 |
| 4,854,201 | 8/1989 | Shinozawa et al. | 83/639.1 |
| 5,114,394 | 5/1992 | Madsen | 83/639.1 |

FOREIGN PATENT DOCUMENTS

| | | | |
|---|---|---|---|
| 824918 | 10/1969 | Canada . | |
| 910714 | 9/1972 | Canada . | |
| 2335447 | 1/1975 | Germany | 100/269.01 |

*Primary Examiner*—Stephen F. Gerrity
*Attorney, Agent, or Firm*—Thelen Reid & Priest LLP

[57] ABSTRACT

A press frame for use with a portable hydraulic power supply in which the power supply comprises a cylinder having a threaded end. The press frame comprises a c-shaped support member having a top arm and at least two bottom arms and an intermediate arm connecting the top and bottom arms. There is provided an aperture in the top arm for receiving a sleeve constructed so as to receive the cylinder of the power supply. There is also provided a lock to threadably engage the threaded end of the cylinder to releasably hold the cylinder in place relative to the press frame.

12 Claims, 2 Drawing Sheets

PRESS FRAME

FIELD OF THE INVENTION

This invention relates to a press frame for use with a portable hydraulic power supply means.

BACKGROUND OF THE INVENTION

Hydraulic presses have any number of uses, from major industrial applications and settings to a basement workshop. Often a hydraulic press is needed at a location remote from an individuals workshop. For example, farmers and mechanics often require a hydraulic press out in the field or at a particular job site. There have thus been a number of portable hydraulic presses created, incorporating both the hydraulic power supply, the cylinder and ram and the press itself In addition, different tasks often require different hydraulics or ram capabilities. Consequently, the industry has developed a number of portable hydraulic power supplies and rams, so-called porta-powers. However, the availability of the portable power supply and ram is only half the equation. It is required to have a press in which the ram can be seated and a workpiece to be manipulated can be placed. Often, even the portable hydraulic presses do not provide the ability to change the hydraulics or the ram or cylinder. Similarly, each different size porta-power requires a different size press to accommodate its particular ram and cylinder. For the farmer, small mechanic or machinist, this requirement has meant that several presses have to be purchased and kept on hand, a different one for use with a particular porta-power. This obviously defeats the purpose of having a portable hydraulic ram.

Attempts in the prior art to provide a portable hydraulic press include those described and illustrated in U.S. Pat. No. 3,686,922 of Bley, issued Aug. 29, 1972, U.S. Pat. No. 4,173,181 of Beneteau, issued Nov. 6, 1979, U.S. Pat. No. 4,686,897 of Frank, issued Aug. 18, 1987, U.S. Pat. No. 3,595,163 of Baumann, issued Jul. 27, 1971. The applicant is also aware of Canadian Patent 824,918 of Hydro-Air Engineering Inc., issued Oct. 14, 1969 and Canadian Patent 910,714 of Guenard, issued Sep. 26, 1972. However, none of the presses disclosed in any of these references provides for portability and the adaptability to various sizes of porta-powers, or different manufacturers of porta-powers and thereby different threads.

SUMMARY OF THE INVENTION

It is thus an object of the present invention to provide a press frame for use with a different portable hydraulic power supply means.

In one aspect of the invention, there is provided a press frame for use with a portable hydraulic power supply means in which the power supply means comprises a cylinder having a threaded end. The press frame comprises a c-shaped support member having a top arm and at least two bottom arms and an intermediate arm connecting the top and bottom arms. There is provided an aperture in the top arm for receiving a sleeve constructed so as to receive the cylinder of the power supply means. There is also provided a locking means to threadably engage the threaded end of the cylinder to releasably hold the cylinder in place relative to the press frame.

In another aspect of the invention, the bottom arms define an open bottom portion of the press frame.

In another aspect of the invention, the locking means comprises a threaded nut affixed to the sleeve.

In yet another aspect of the invention, the locking means comprises a flange affixed to the sleeve and one of a plurality of nuts releasably attachable to the flange, each of the plurality of nuts sized to threadably engage the threaded end of the cylinder having a different size or thread.

The press frame of the present invention thus provides a means of accommodating different portable power supplies while still providing a work area sufficient for most workpieces. The press frame can be quickly adapted to suit the size of the particular power supply required for any given job. It eliminates the need for carrying a large number of similar press frames.

BRIEF DESCRIPTION OF THE DRAWINGS

These and other advantages of the invention will become apparent upon reading the following detailed description and upon referring to the drawings in which.

Figure 1:
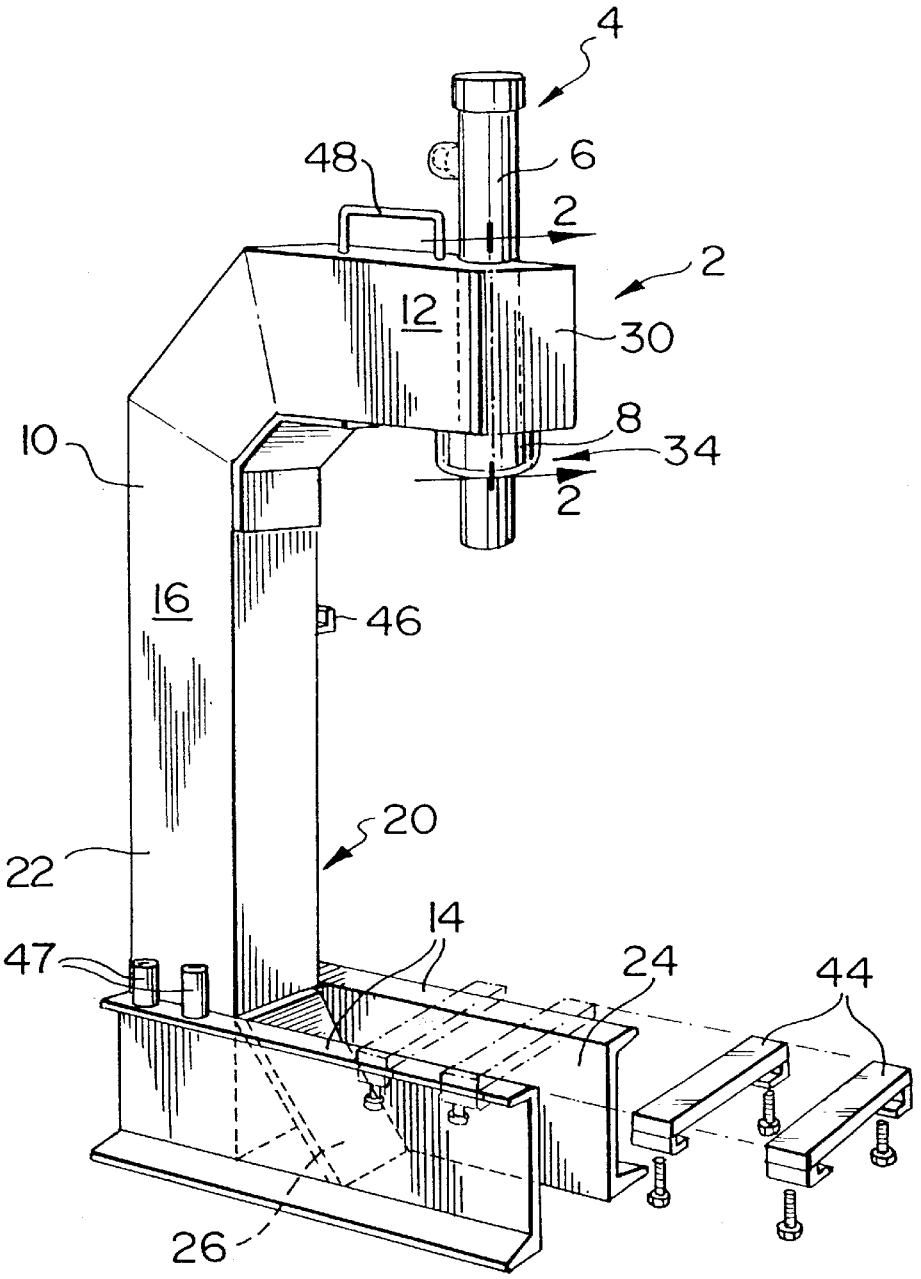
FIG. 1 is a perspective view of the press frame in accordance with the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to the drawings, FIG. 1 illustrates a press frame 2 for use with a portable hydraulic power supply 4. The power supply 4 comprises a cylinder 6 which has a threaded end 8.

The press frame 2 comprises a c-shaped support member 10 which has a top arm 12 and at least two bottom arms 14, with an intermediate arm 16 connecting the top 12 and bottom 14 arms. The top 12 and intermediate 16 arms may be of unitary construction or may be several discreet pieces welded together to form the upper portion of the c-shape. The bottom arms 14 will typically be a pair of c-channels affixed to opposing sides 20, 22 of the intermediate arm thereby defining an open bottom portion 24 of the press frame 2. An additional plate 26 may be welded to the intermediate arm 16 and the bottom arms 14 to provide additional support to the press frame 2.

In the top arm 12, there is provided an aperture 30 sized to receive a sleeve 32, which sleeve 32 could be in the form of a length of pipe, in any suitable material, adapted to receive the cylinder 6 of the portable hydraulic power supply 4.

Figure 2:
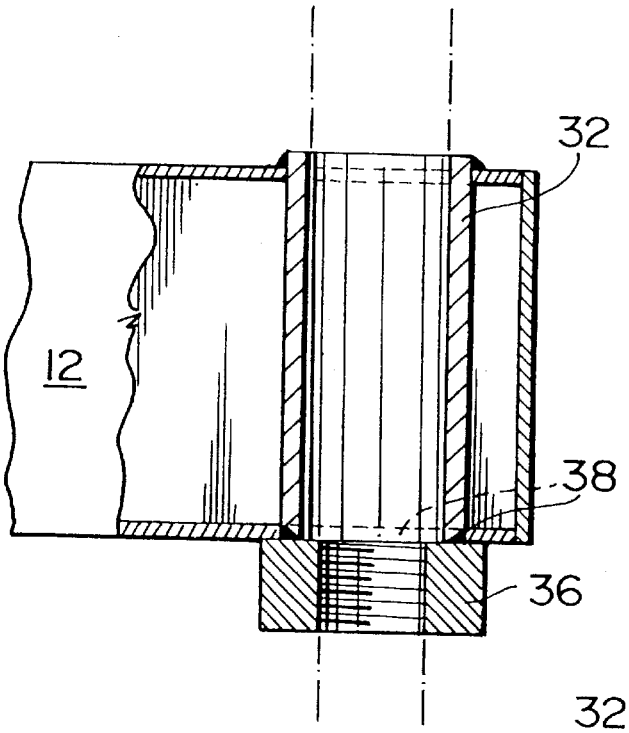
FIG. 2 is a partial cross-sectional view, taken along line 2—2 of FIG. 1 of one embodiment of the present invention.
Figure 3:
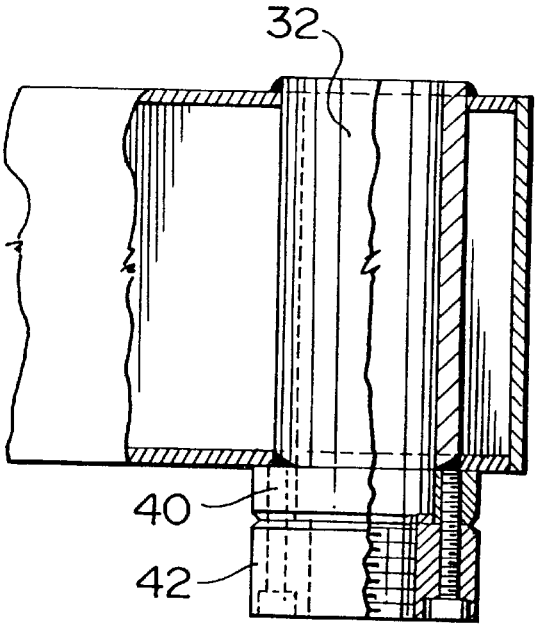
FIG. 3 is a fragmentary view, partially in cross-section, taken along line 2—2 of FIG. 1 of another embodiment of the present invention.

In order to hold the cylinder 6 of the portable hydraulic power supply 4 in place within the press frame 2, there is provided a locking means 34 in the form of either a threaded nut 36 affixed to the bottom 38 of the sleeve 32, such as by welding or similar means (as shown in FIG. 2) or a flange 40 affixed to the bottom 38 of the sleeve 32 and one of a plurality of threaded nuts 42 releasably attachable to the flange 40 (as shown in FIG. 3). In either case, the threaded nut 36 or 42 is sized to accept the threaded end 8 of the cylinder 6 of the portable hydraulic power supply 4.

In the embodiment shown in FIG. 2, the threaded nut 36 is welded to the sleeve 32. Thus, the press frame 2 of that embodiment is specifically tailored for one particular portable power supply having a specific size cylinder and threaded end. Thus, the press frame 2 is unique to a single power supply 4. In the embodiment shown in FIG. 3, the press frame 2 is adapted to receive virtually any size power supply currently on the market. The threaded nut 42 is releasably attachable to the flange 40 which has been welded to the sleeve 32. Thus, the choice of nut 42 will be based on the size of the particular power supply 4 being used, in a manner to be more fully described below.

As shown in FIG. 1, the press frame 2 may also comprise one or more arbor plates 44 or similar supports to create a work surface. There is thus incorporated into the press frame 2 a particular flexibility. With the open bottom 24 a workpiece (not shown) can extend beyond the bottom of the press frame 2. However, with the optional and releasably attachable arbor plates 44, a smaller workpiece (not shown) can also be effectively worked upon. The open bottom 24 also assists in allowing the press frame 2 to be used in a horizontal orientation so that it is essentially unshaped (for example, by rotating FIG. 1 90 degrees counterclockwise), wherein the intermediate arm 16 actually forms a base.

Preferably on the intermediate arm 16, there is also provided an additional holder 46 to support a portion of the hydraulic power supply 4 as needed. That holder may optionally take the form of an extension 47 on one of the bottom arms 14. The top arm 12 may also be provided with a handle 48 for portability of the press frame 2 as a whole.

In use, the press frame 2 will be chosen to match with the portable hydraulic power supply 4 being used. If the portable hydraulic power supply 4 is to be used repeatedly then it would be advantageous to have the press frame 2 configured to match that power supply 4 by affixing a threaded nut 36 on the sleeve 32. When used, the cylinder 6 is then slid through the sleeve 32 with the threaded end 8 engaging the threaded nut 36 and the cylinder is thus held in releasably held in place within the press frame 2. It is a fairly simple step of then releasing the cylinder 6 from the press frame 2 by undoing the threaded engagement between the threaded end 8 and the threaded nut 36 which has been affixed (such as by welding) to the sleeve 32.

Where, however, several different power supplies are to be use with the same press frame, applicant's invention provides the adaptability by having the series of interchangeable nuts 42 which can be connected to the flange 40, either by means of a threaded engagement (not shown) or by means of a at least one bolt 52 which passes through the nut 42 and the flange 40. It is contemplated to provide two standard sizes of press frame 2. The first would be a 4 ton in which two bolts 52 would be used. The second size would be a 10 ton, in which three bolts 52 will be used. Irrespective of the size of the press frame 2 being used, the overall configuration is the same and the manner of use of the interchangeable nuts is the same.

Figure 4:
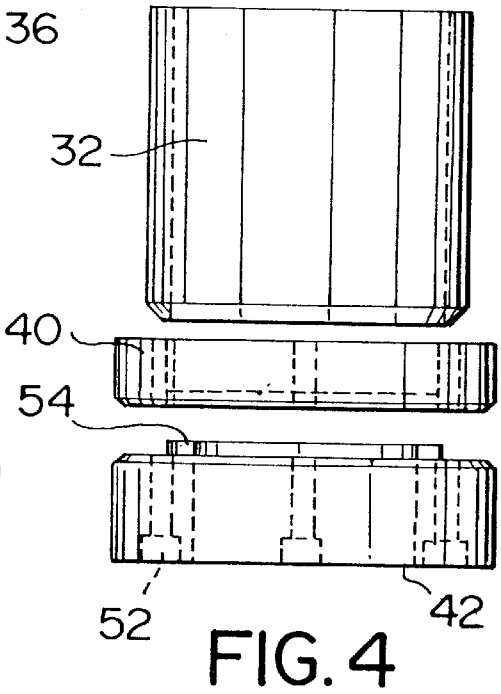
FIG. 4 is an exploded view of the portion of the invention as shown in FIG. 3.

The user will choose an appropriate nut 42 based on the size of the power supply 4 and its cylinder 6 and threaded end 8. That nut 42 will then be releasably attached to the flange 40 which has been permanently affixed to the sleeve 32. To assist in attaching the nut 42 to the flange 40, there may also be provided a locator 54 to concentrically align the nut 42 and the flange 40 (as best seen in FIG. 4), although it should be noted that the bolts 52 will perform the same concentrically aligning function in normal operation.

Once the nut 42 has been attached to the flange 40, the press frame 2 operates essentially as before, by passing the cylinder 6 through the sleeve 32 and threading the threaded end 8 into the threaded nut 42. The press frame 2 is then ready to use in combination with the power supply 4 as a hydraulic press.

Thus, it is apparent that there has been provided in accordance with the invention a press frame for use with a portable hydraulic power supply means that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

The embodiments of the invention in which an exclusive property or privilege is claimed are defined as follows:

1. A press frame for use with a portable hydraulic power supply means, said power supply means comprising a cylinder having a threaded end, said press frame comprising:

a c-shaped support member having a top arm and at least two bottom arms and an intermediate arm connecting said top and bottom arms;

an aperture in said top arm for receiving a sleeve constructed so as to receive said cylinder of said power supply means;

locking means to threadably engage said threaded end of said cylinder to releasably hold said cylinder in place relative to said press frame.

2. The press frame of claim 1 wherein said bottom arms define an open bottom portion of said press frame.

3. The press frame of claim 2 further comprising at least one arbor plate positioned across said open bottom portion to form a bottom support.

4. The press frame of claim 1 wherein said locking means comprises a threaded nut affixed to said sleeve.

5. The press frame of claim 4 wherein said threaded nut is welded to said sleeve.

6. The press frame of claim 1 wherein said locking means comprises a flange affixed to said sleeve and one of a plurality of nuts releasably attachable to said flange, each of said plurality of nuts sized to threadably engage said threaded end of said cylinder having a different size.

7. The press frame of claim 6 wherein each of said plurality of nuts include a locating means to concentrically align said nut with said flange.

8. The press frame of claim 6 wherein said one of said plurality of nuts is releasably attached to said flange by means of at least one bolt.

9. The press frame of claim 1 further comprising a holding means mounted to said intermediate arm to support said power supply means.

10. The press frame of claim 1 in which said frame is oriented to be substantially u-shaped, so that said intermediate arm forms a base.

11. A hydraulic press comprising, in combination a portable hydraulic power supply means comprising a cylinder having a threaded end; and a press frame comprising a c-shaped support member having a top arm and at least two bottom arms and an intermediate arm connecting said top and bottom arms;

an aperture in said top arm for receiving a sleeve constructed so as to receive said cylinder of said power supply means;

locking means to threadably engage said threaded end of said cylinder to releasably hold said cylinder in place relative to said press frame.

12. A press frame for use with a portable hydraulic power supply means, said power supply means comprising a cylinder having a threaded end, said press frame comprising a c-shaped support member having a top arm and at least two bottom arms and an intermediate arm connecting said top and bottom arms, wherein said bottom arms define an open bottom portion of said press frame;

at least one arbor plate positioned across said open bottom portion to form a bottom support;

an aperture in said top arm for receiving a sleeve constructed so as to receive said cylinder of said power supply means;

locking means to threadably engage said threaded end of said cylinder to releasably hold said cylinder in place relative to said press frame, said locking means comprising a flange affixed to said sleeve and one of a plurality of nuts releasably attachable to said flange, each of said plurality of nuts sized to threadably engage said threaded end of said cylinder having a different size.

* * * * *